US005915790A

United States Patent [19]

Sakai et al.

[11] Patent Number: 5,915,790

[45] Date of Patent: Jun. 29, 1999

[54] TUNNEL BORING MACHINE

[75] Inventors: Takashi Sakai; Sohta Takatsu; Yoshiaki Ishida, all of Tokyo; Yoshihito Minami, Osaka; Tomio Jatani, Tokyo, all of Japan

[73] Assignees: Hazama Corporation, Tokyo; Sato Kogyo Co., Ltd., Toyama; Komatsu Ltd.; Maeda Corporation, both of Tokyo, all of Japan

[21] Appl. No.: 08/836,372

[22] PCT Filed: Nov. 14, 1995

[86] PCT No.: PCT/JP95/02314

§ 371 Date: May 12, 1997

§ 102(e) Date: May 12, 1997

[87] PCT Pub. No.: WO96/15353

PCT Pub. Date: May 23, 1996

[30] Foreign Application Priority Data

Nov. 15, 1994 [JP] Japan ..... 6-280282

[51] Int. Cl.[6] ..... E21D 9/08

[52] U.S. Cl. ..... 299/1.3; 299/31; 299/33; 405/142

[58] Field of Search ..... 299/1.3, 31, 33; 405/138, 142, 143

[56] References Cited

U.S. PATENT DOCUMENTS

| | | | |
|---|---|---|---|
| 4,140,345 | 2/1979 | Babendererde et al. | 405/142 X |
| 5,527,099 | 6/1996 | Fikse | 299/33 X |

FOREIGN PATENT DOCUMENTS

| | | |
|---|---|---|
| 58-185691 | 12/1983 | Japan . |
| 3-63393 | 3/1991 | Japan . |
| 4-353192 | 12/1992 | Japan . |
| 6-173575 | 6/1994 | Japan . |
| 6-173576 | 6/1994 | Japan . |
| 7-26890 | 1/1995 | Japan . |

*Primary Examiner*—David J. Bagnell
*Attorney, Agent, or Firm*—Armstrong, Westerman, Hattori, McLeland & Naughton

[57] ABSTRACT

A cutterhead is supported at the front part of a main frame so as to incline at a specified angle with respect to a vertical plane. The main frame includes (i) a roof support disposed at a position corresponding to where a reaction force acts in the direction of the periphery of a tunnel against a force caused by rotation of the cutterhead, and (ii) a pusher for pushing the roof support toward the cutterhead resisting the reaction force.

6 Claims, 10 Drawing Sheets

$\Phi = 8.80$
$\theta = 0°$
$M = 60.82$ $\Phi = 9.60$
$\theta = 39.5°$
$M = 55.86$ $\Phi = 10.10$
$\theta = 45°$
$M = 56.65$

TUNNEL BORING MACHINE

TECHNICAL FIELD

The present invention relates to a tunnel boring machine, and more particularly to a tunnel boring machine for excavating a tunnel of an oval cross-section.

BACKGROUND ART

One known tunnel boring machine for use in excavation of a rock-bed is designed to have a cylindrical cutterhead at the front part of the machine body and this cutterhead includes a circular cutting face at its front face with respect to an advancing direction. Such a tunnel boring machine includes a pair of gripper assemblies that are slidable back and forth relative to the tunneling machine body and are interconnected to the tunneling machine body by means of thrust cylinders. As the cutterhead rotates, the thrust cylinders extend with the gripper assemblies being pushed against the wall of the tunnel, which allows the tunneling machine body to advance while excavating. After the advance of the tunneling machine body with a specified pitch for excavation, the gripper assemblies are released from its pressed condition and then moved forward relative to the tunneling machine body by the contraction of the thrust cylinders. With this procedure, continuous advance of the tunnel boring machine is carried out. Such a tunnel boring machine is usually used for excavating tunnels having a circular cross-section such as water channels, aqueducts and sewers.

The above tunnel boring machine is however unsuitable for use in excavating tunnels for double track railways and roads which require a space of a rectangular cross-section, and if the above tunnel boring machine is used for excavating such tunnels, a significant amount of superfluous excavation is incurred so that there arises a need for back filling etc. after excavation. This leads to additional cost and labor and therefore the above tunnel boring machine presents the problems of inefficiency and poor cost performance.

As an attempt to reduce the amount of superfluous excavation, Japanese Patent Laid-Open Publication No. 4-353192 (1992) proposes a tunnel boring machine for excavating a tunnel of an oval cross-section. The tunnel boring machine disclosed in this publication is designed such that a cutterhead having a circular cutting face is inclined by the telescopic motion of a cylinder member at a desired angle with respect to the tunneling machine body thereby to excavate a tunnel of a desired oval shape.

Japanese Patent Laid-Open Publication No. 7-26890 (1995) discloses another tunneling machine that has a cutterhead capable of inclining at a desired angle relative to the tunneling machine body. This tunneling machine has a pusher that exerts a pressing force on the cutterhead, and this pressing force resists a reaction force against excavation (hereinafter referred to as "excavating reaction force") acting in the direction of the periphery of the tunnel because of the inclination of the cutterhead and causes at the same time a reaction force of the tunnel wall.

The above described types of boring machines for tunnels of an oval cross-section use a cutterhead that is adjustable to incline at desired angles and therefore require a mechanism such as a cylinder member for changing the angle of the cutterhead. Since the whole of an excavating reaction force is imposed on the mechanism such as a cylinder member during excavation, the cylinder member is required to be pretty large in size. In addition, in order to maintain the angle of inclination of the cutterhead constant during excavation, a large sized and complex control mechanism is needed for controlling the cylinder member.

In the above tunnel boring machines for tunnels of an oval cross-section, the roof support (support member) which receives an excavating reaction force acting in the direction of the periphery of the tunnel because of the inclination of the cutterhead is designed to move in an integral fashion with the tunneling machine body so that an extremely great friction force is generated between the roof support and the tunnel wall during the advance of the tunneling machine body. This friction force works as a resistance to the tunneling machine body during its advance, which hinders the smooth advance of the tunneling machine body.

The present invention has been made for the purpose of overcoming the above problems and a prime object of the invention is therefore to provide a tunnel boring machine for use in excavation of a tunnel of an oval cross-section, which is simple in structure.

Another object of the invention is to provide a tunnel boring machine for use in excavation of a tunnel of an oval cross-section, which is capable of reducing a friction force generated between the tunnel wall and a support member that receives an excavating reaction force working in the direction of the periphery of the tunnel.

DISCLOSURE OF THE INVENTION

The first object can be achieved by a tunnel boring machine according to the invention for use in excavation of a tunnel of an oval cross-section, the tunnel boring machine comprising:

(a) a tunneling machine body;

(b) a cutterhead supported at a front part of the tunneling machine body so as to incline at a specified angle with respect to a vertical plane and having a circular cutting face at the front face of the cutterhead with respect to an advancing direction;

(c) a support member located in a position where it can resist a reaction force that acts in the direction of the periphery of the tunnel against a thrust force acting on the cutterhead;

(d) pushing means for pushing the support member toward the cutterhead, resisting the reaction force; and (e) control means for controlling the pushing means so as to constantly keep the support member at a certain position relative to the tunneling machine body.

In the tunnel boring machine of the invention having the above features, since the cutterhead is supported so as to incline at a specified angle with respect to a vertical plane, a tunnel having an oval cross-section is excavated when the tunneling machine body advances with the cutterhead being rotated. In the course of excavation, an excavating reaction force generated in the direction of the periphery of the tunnel due to the angle of inclination of the cutterhead is received by the support member and this excavating reaction force imposed on the support member is offset by a reaction force of the tunnel wall that is generated when the support member is pushed toward the cutterhead by the pushing means, whereby desired excavation in a specified advancing direction can be achieved. Further, since the tunnel boring machine of the invention includes a control means for controlling the pushing means so as to constantly maintain the support member at a certain position relative to the tunneling machine body, the support member is always kept at a certain position so that the straight-ahead movement of the tunneling machine body can be maintained.

According to the invention, since the angle of inclination of the cutterhead is fixed with respect to the tunneling machine body, the structure of the tunnel boring machine can be extremely simplified compared to prior tunnel boring machines in which the angle of inclination of the cutterhead is adjustable according to necessity and stable excavation of a tunnel having a constant oval cross-section can be ensured.

To achieve the second object, the tunnel boring machine of the invention preferably includes a position adjusting means for keeping the support member and the pushing means at respective specified positions during advance of the tunneling machine body and for moving, after the tunneling machine body has advanced with a specified pitch, the support member and the pushing means back to the respective positions where they were located before the advance of the tunneling machine body. In the case of the machine equipped with such a position adjusting means, the tunneling machine body advances with the support member being pushed against the natural ground by the pushing means during the forward movement of the tunneling machine body (i.e., excavation). As the tunneling machine body and the pushing means are designed to slide at that time, only the tunneling machine body moves forward while the support member is stationary relative to the tunnel wall, receiving a reaction force from the tunnel wall. At the same time, the position adjusting means is allowed to contract. After that, the tunneling machine body advances with a specified pitch and the pushing means is allowed to contract, retracting the support member from the natural ground. In this condition, the position adjusting means extends to move the support member and the pushing means forward to their initial positions relative to the tunneling machine body. In this way, the friction force generated between the support member and the tunnel wall at the time of the advance of the tunneling machine body can be replaced by a small reaction force between the pushing means and the tunneling machine body, whereby the resistance generated during the advance can be reduced to achieve a smooth advance movement. The position adjusting means may be a hydraulic cylinder located between the tunneling machine body and the pushing means.

The pushing means includes a hydraulic cylinder disposed between the tunneling machine body and the support member and the control means may be a cylinder controller for controlling the stroke of this hydraulic cylinder to be equal to a reference stroke at all times.

The angle of inclination of the cutterhead with respect to a vertical plane preferably ranges from 32° to 45°. The reason for this is that in cases where a double vehicular traffic lane tunnel or a double track railway tunnel for example is excavated, superfluous excavation can be minimized thereby to shorten the term of works and improve the operational efficiency.

Regarding the force imposed on the cutterhead that is inclined at an angle θ, when an advancing force is given to the inclined cutters, the load $P_d$ on the cutters is divided into a load $P_d\cos\theta$ acting in a thrusting direction and a load $P_d\sin\theta$ acting downward in a vertical direction, as shown in FIG. 11. The cutterhead receives a force $P_d\cos\theta$ acting in a direction opposite to the thrusting direction and a force $P_d\sin\theta$ acting upward in a vertical direction from the natural ground, these forces corresponding to the above component forces $P_d\cos\theta$ and $P_d\sin\theta$. Therefore, if the angle of inclination θ of the cutterhead exceeds 45°, $P_d\sin\theta$ becomes greater than $P_d\cos\theta$, in other words, the floating force of the tunneling machine body becomes greater than its thrust force, leading to a significant loss of thrust. As a result, the support member needs a great force to restrict the floating force of the tunneling machine body. For this reason, the upper limit θ of the angle of inclination of the cutterhead is determined to be 45°. Its lower limit is determined to be 32° because the cross-sectional area that can be obtained with an inclination angle of 32° is equivalent to that obtained with an inclination angle of 45°.

In the invention, it is preferable to mount the outermost cutter of the cutterhead so as to incline at a specified angle in relation to a cutterhead face plate. This permits the cutter to excavate the outermost peripheral face of the tunnel although the cutterhead is mounted on the tunneling machine body so as to incline with respect to it.

Other objects of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The invention will be best understood from the following detailed description when taken in conjunction with the accompanying drawings which discloses a certain embodiment of the invention but is not limitative of the scope of the invention.

BEST MODE FOR CARRYING OUT THE INVENTION

Referring now to the accompanying drawings, a tunnel boring machine according to one embodiment of the invention will be hereinafter described.

Figure 1:
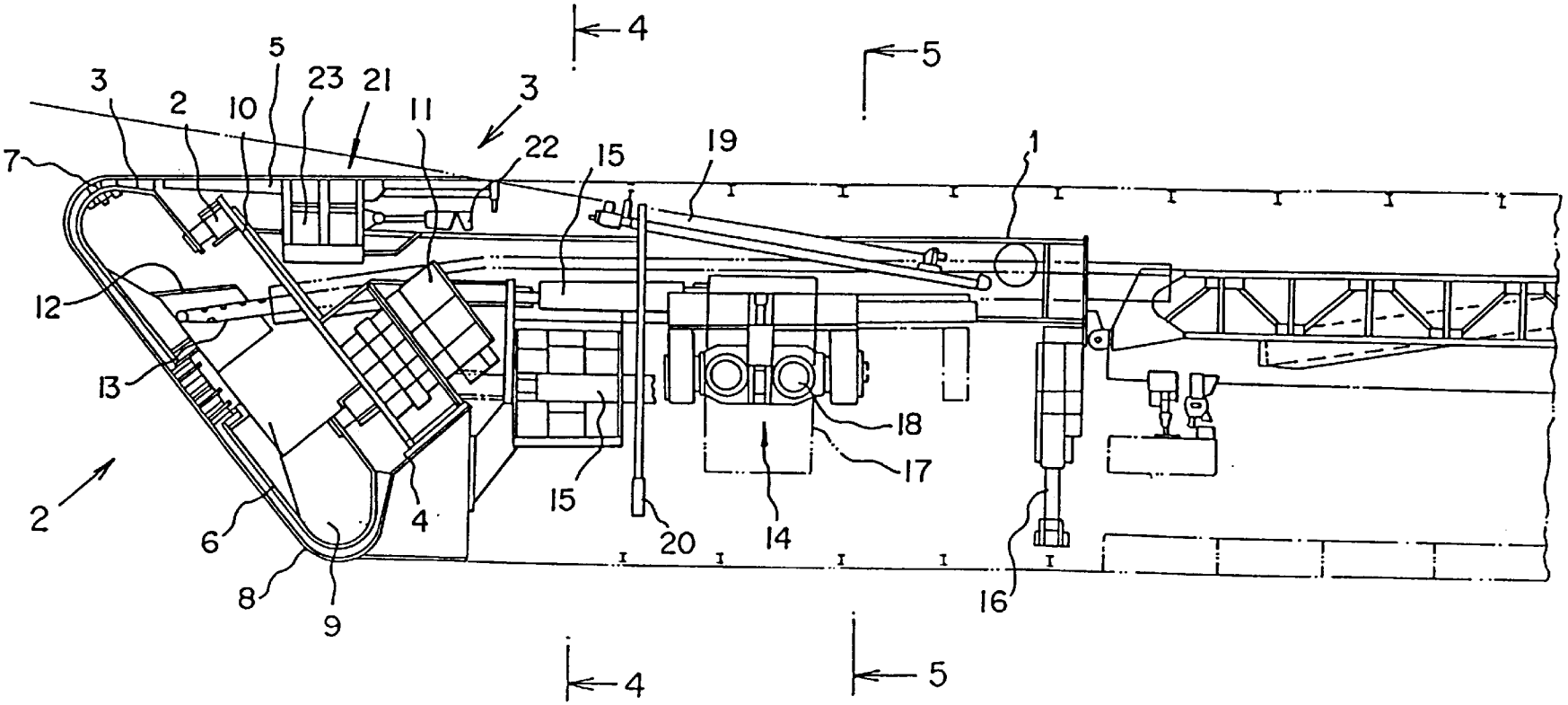
FIG. 1 is a longitudinal sectional view of a tunnel boring machine according to one embodiment of the invention.
Figure 2:
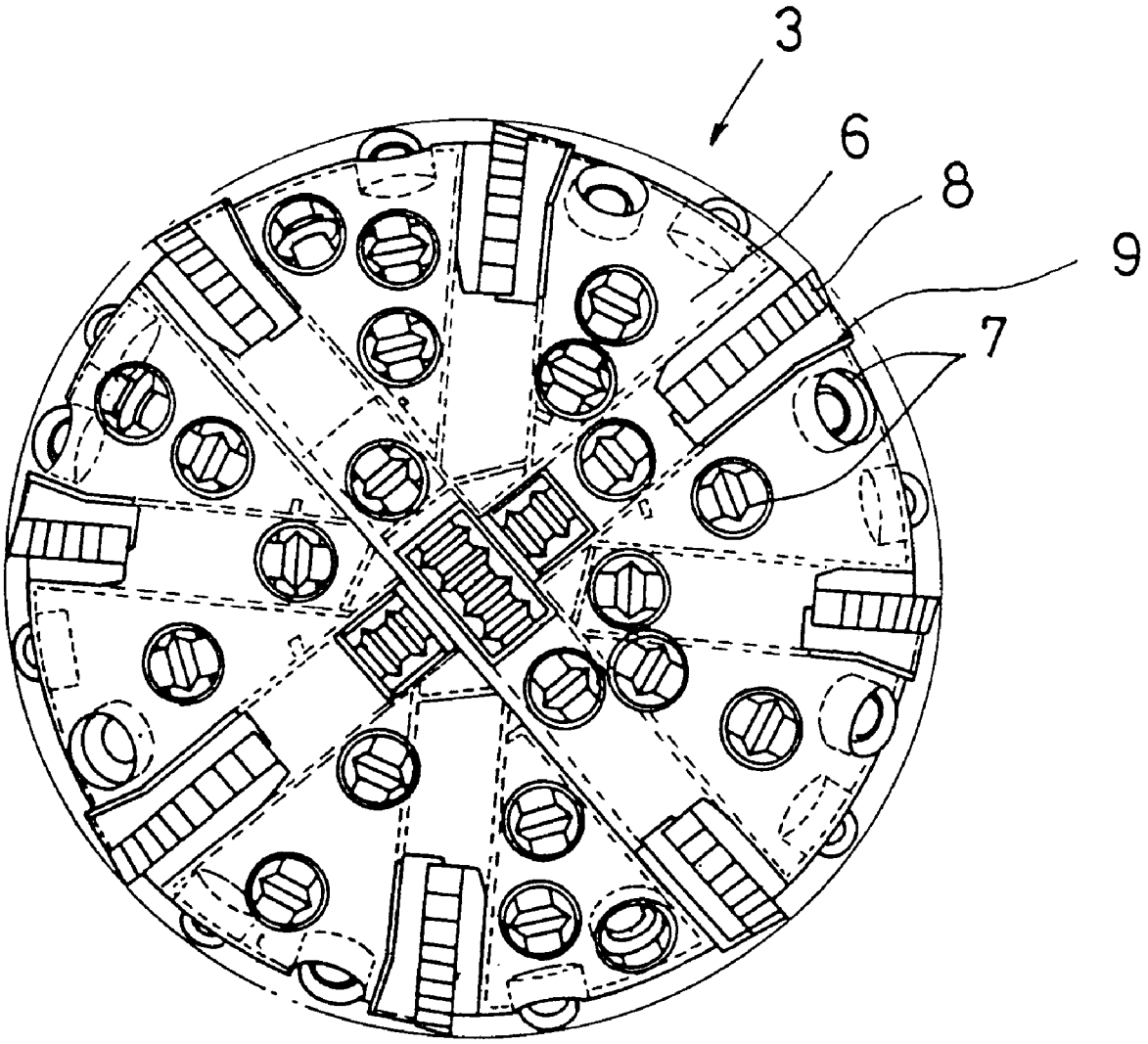
FIG. 2 is a view taken in the direction of arrow A of FIG. 1.
Figure 3:
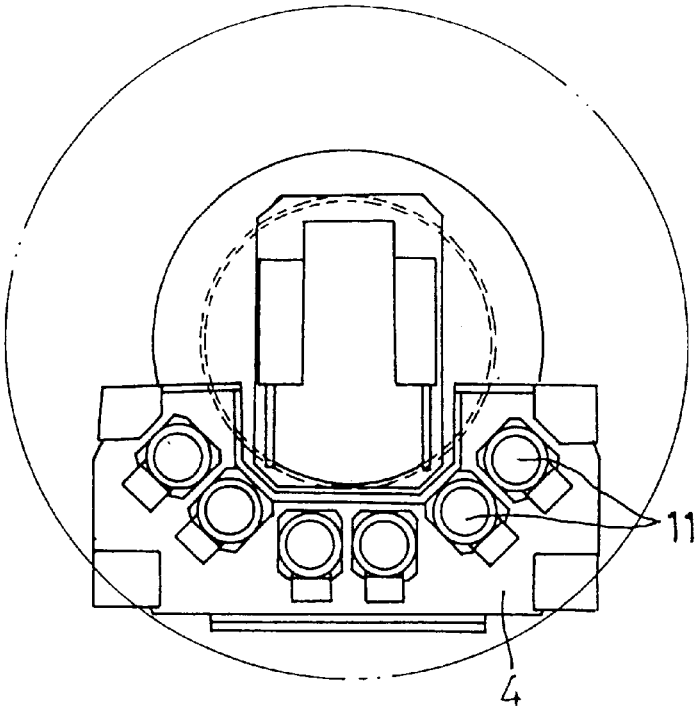
FIG. 3 is a view taken in the direction of arrow B of FIG. 1.
Figure 4:
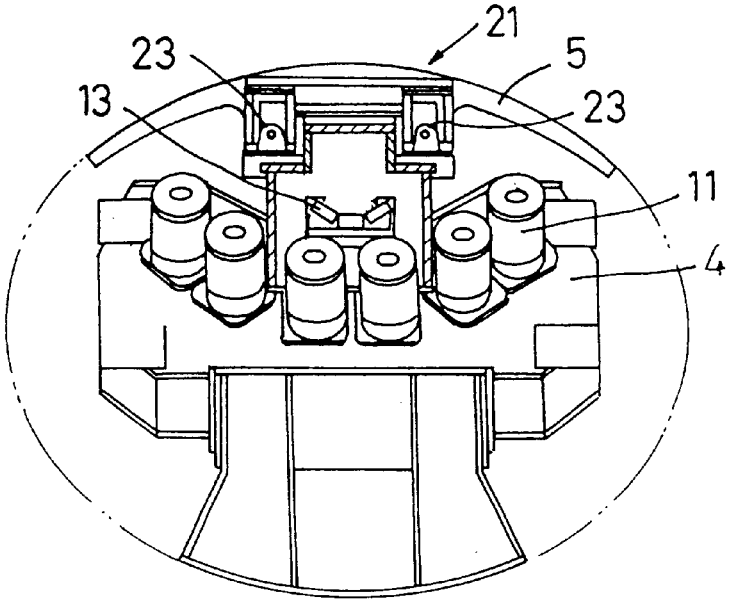
FIG. 4 is a sectional view taken along line C—C of FIG. 1.
Figure 5:
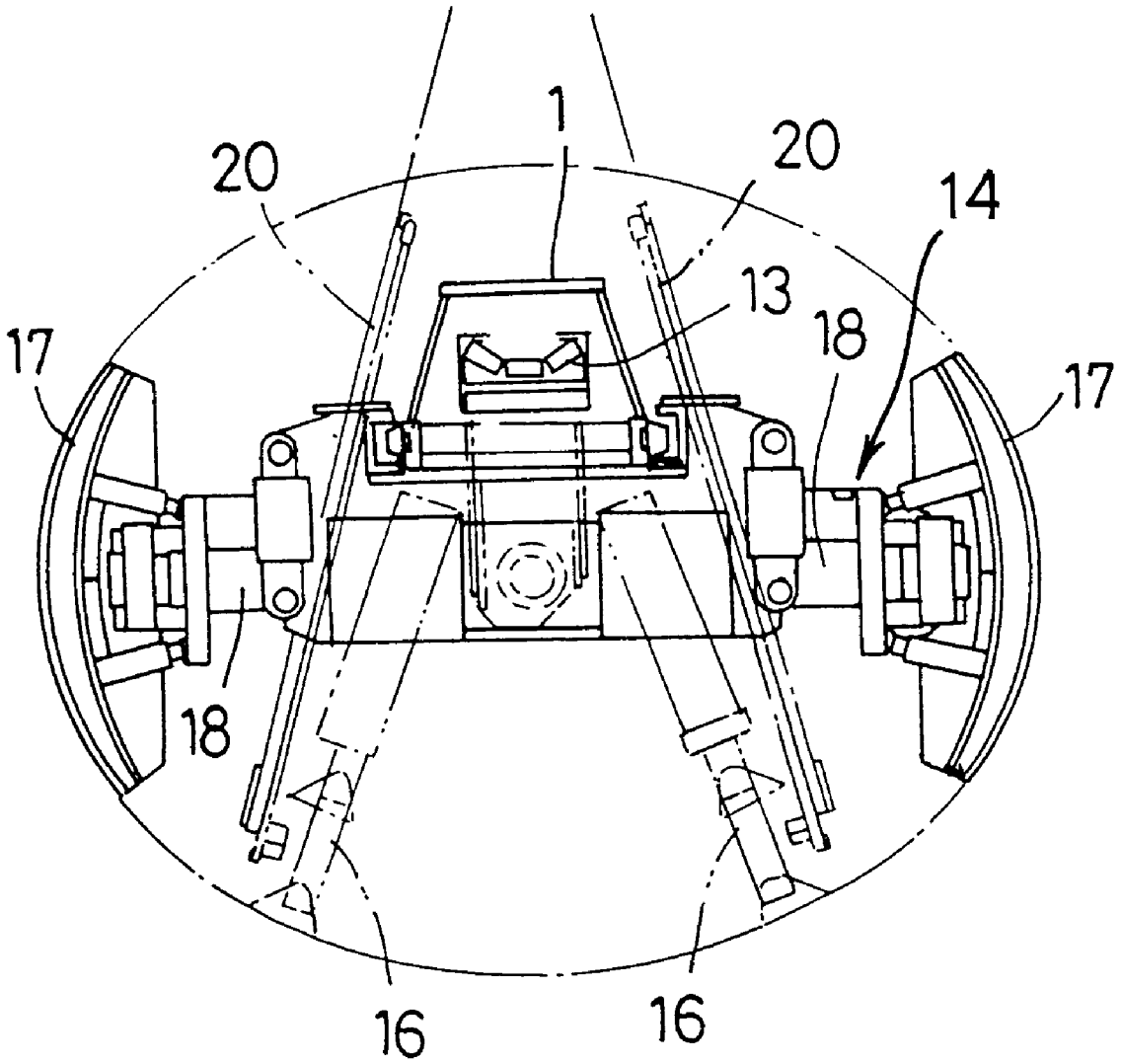
FIG. 5 is a sectional view taken along line D—D of FIG. 1.

FIG. 1 illustrates a longitudinal section of a tunnel boring machine according to one embodiment of the invention, FIG. 2 is a view taken in the direction of arrow A of FIG. 1, FIG. 3 is a view taken in the direction of arrow B of FIG. 1, FIG. 4 is a view taken along line C—C of FIG. 1 and FIG. 5 is a view taken along line D—D of FIG. 1.

In the tunnel boring machine of this embodiment, a main frame 1 is shown to extend longitudinally and a cutterhead 3 is rotatably attached to the front part of the main frame 1 with the aid of bearings 2 so as to incline at a specified angle with respect to a vertical plane. The angle of inclination of the cutterhead 3 with respect to a vertical plane is preferably in the range of from 32° to 45° for the reason as described later. The cutterhead 3 is supported by a cutterhead support 4 attached to the front part of the main frame 1 and a roof support 5 (described later) is disposed on the upper portion of the main frame 1. The tunnel boring machine is accordingly designed to advance for excavation, with the cutterhead support 4 and the roof support 5 receiving upward and downward forces.

The cutterhead 3 has a circular cutting face at the front face thereof. In the cutterhead 3, there are provided a plurality of rolling cutters 7 that are rotatably supported at the center and periphery of a front face plate 6. Provided in the vicinity of the periphery of the front face plate 6 are a plurality of scrapers 8 for trapping muck and a pickup plate 9 for scooping up the muck trapped by the scrapers 8.

The cutterhead 3 is driven by a plurality of driving motors 11 (six motors in this embodiment) supported by the cutterhead support 4. These driving motors 11 are mounted, being gathered together in the lower half portion of the cutterhead 3 as shown in FIGS. 3 and 4. With this arrangement, interference with the driving motors 11 by other mechanisms can be avoided and more efficient use of space is achieved within the machine.

Disposed substantially at the center of the cutterhead 3 is a hopper chute 12 that receives the muck trapped by the cutterhead 3. Underneath the hopper chute 12 is positioned the base end of a belt conveyor 13 that conveys the muck received from the hopper chute 12 backward. The belt conveyor 13 extends along the main frame 1 backwardly of the main frame 1. In such an arrangement, as the cutterhead 3 rotates with the rolling cutters 7 cutting the tunnel face, the muck cut from the tunnel face is scooped up by the pickup plate 9 to be delivered into the hopper chute 12 and then onto the belt conveyor 13. The belt conveyor 13 carries the muck backwardly out of the tunnel.

A gripper assembly 14 is disposed on each side of the main frame 1 and this pair of gripper assemblies 14 are slidable back and forth relative to the main frame 1. The front parts of the gripper assemblies 14 are coupled to the front parts of the main frame 1 by means of a plurality of thrust cylinders 15 that urge the main frame 1 to advance forwardly for tunneling operation. Disposed at the rear end of the main frame 1 are rear supports 16 for supporting the main frame 1 from underneath with the aid of a cylinder mechanism. The rear supports 16 serve to support the main frame 1 when the main frame 1 has been released from a condition in which the main frame 1 is fixedly held to the tunnel wall by the gripper assemblies 14.

As shown in FIG. 5, each gripper assembly 14 comprises a gripper shoe 17 having the substantially same curvature as the inner peripheral face of the cut tunnel wall and a gripper cylinder 18 for moving the gripper shoe 17 outward to be pressed against the tunnel face. The respective gripper shoes 17 are pressed against the tunnel face by the operation of the gripper cylinders 18 whereby the main frame 1 is held in the tunnel. In FIG. 1, reference numeral 19 represents an advanced borer which bores into the ground prior to the advance of the tunnel boring machine. Reference numeral 20 in FIGS. 1 and 5 represents a rock drill for boring into rock to make holes through which steel reinforcing elements are inserted for the reinforcement of the tunnel wall after excavation.

Advance/excavation by means of the gripper assemblies 14, the rear supports 16 and the thrust cylinders 15 is performed as described below.

Firstly, the gripper cylinders 18 of the gripper assemblies 14 are operated to extend so that the gripper shoes 17 are pressed against the tunnel wall to fixedly hold the main frame 1 on the ground. In this condition, while the cutterhead 3 being rotated, the thrust cylinders 15 are extended and a reaction force reacting against the gripper assemblies 14 is obtained so that the main frame 1 moves forward for excavation. At that time, the rear supports 16 are in their retracted state.

After the thrust cylinders 15 extend to the end of the stroke and the advance with a specified pitch is completed so that the main frame 1 is suspended, the rear supports 16 extend to press the main frame 1 against the tunnel wall thereby fixing the main frame 1 on the ground, while the gripper cylinders 18 of the gripper assemblies 14 contract thereby retracting the gripper shoes 17 from the tunnel wall. In this condition, the thrust cylinders 15 contract pulling the gripper assemblies 14 forwardly to their initial positions. The above process is repeated so that continuous advance is carried out.

Next, the structure of the roof support 5 will be explained concretely.

Figure 6:
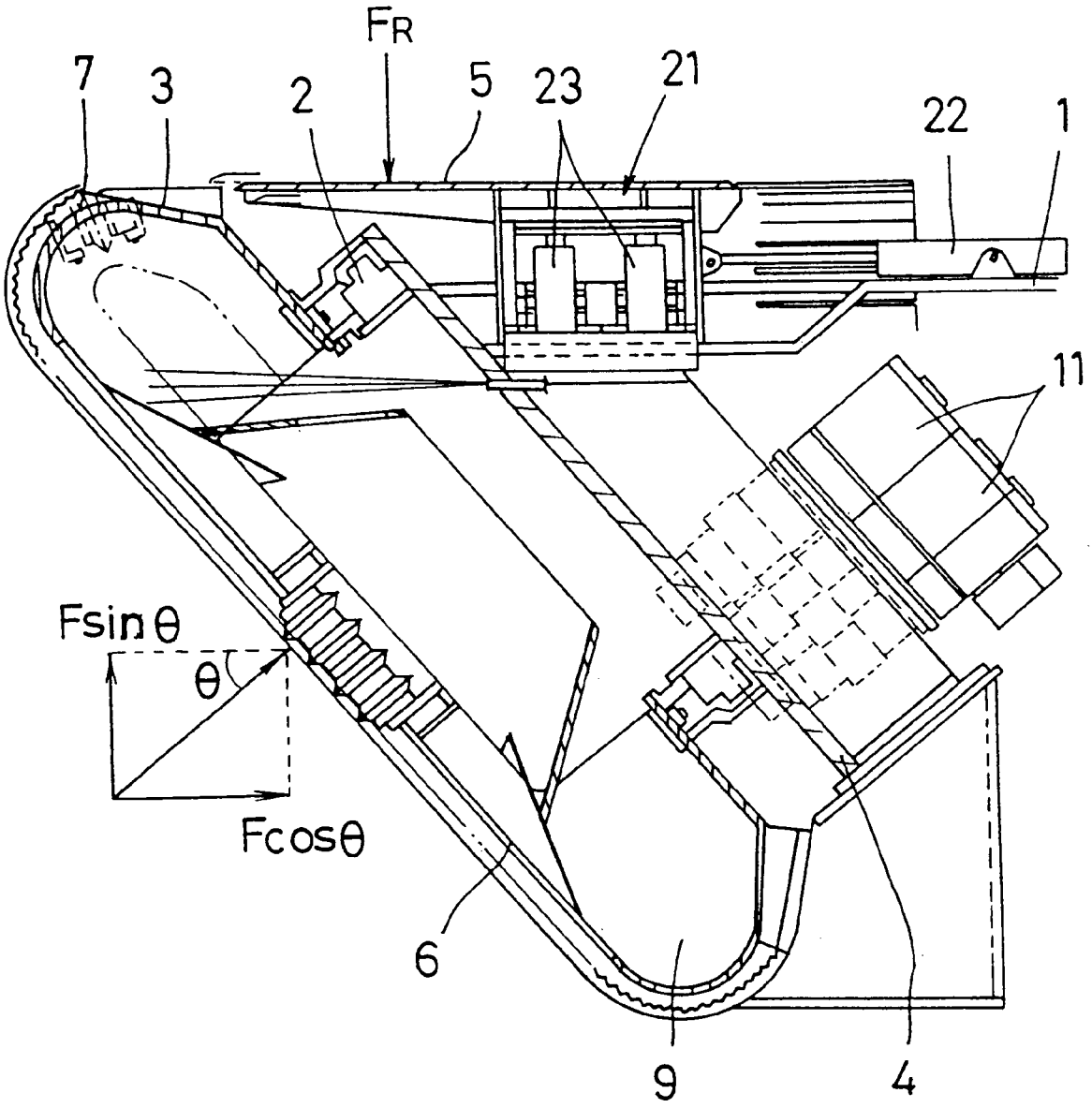
FIG. 6 is an enlarged sectional view showing the essential part of the tunnel boring machine shown in FIG. 1.

The roof support 5 has such an arcuate cross-section as to contact the tunnel wall and is located, as shown in FIG. 6, at a position above and behind the rear face of the cutterhead 3 (i.e., the position on which the excavating reaction force generated in the direction of the periphery of the tunnel due to the inclination of the cutterhead 3 is imposed). The roof support 5 is mounted on the top of a pusher 21 that is slidable back and forth with respect to the main frame 1. The roof support 5 is slid back and forth in an integral fashion with the pusher 21 by operation of a sliding cylinder 22 mounted on the main frame 1. The pusher 21 includes a plurality of roof support cylinders 23 and the forward ends of the respective rods of the roof support cylinders 23 are coupled to the underside of the roof support 5.

The roof support 5 having the above structure is operated as follows during advance of the tunneling machine body.

During forward movement of the main frame 1 (i.e., during excavation), the roof support 5 is first pressed against the natural ground by the roof support cylinders 23 and then the thrust cylinders 15 are extended thereby forwardly moving the main frame 1. Since the main frame 1 and the pusher 21 are designed to slide at that time, only the tunneling machine body moves forward while the roof support is kept stationary with respect to the tunnel wall, receiving a reaction force from the tunnel wall. In the mean time, the sliding cylinder 22 is contracted. Thereafter, when the tunneling machine body advances with a specified pitch, the roof support cylinders 23 are contracted, thereby retracting the roof support 5 from the natural ground. In this situation, the sliding cylinder 22 is extended thereby moving the roof support 5 and the pusher 21 forwardly to their initial positions with respect to the main frame 1. Thus, the friction force generated between the roof support 5 and the tunnel wall during advance of the tunneling machine body can be replaced by the smaller friction force between the pusher 21 and the main frame 1, whereby the resistance generated during advance can be reduced to ensure smoother tunneling operation.

In the tunnel boring machine of this embodiment, since the cutterhead 3 is inclined, when thrust acts on the cutterhead 3 from behind, an upward reaction force Fsinθ of the working face against excavation (F: cutter load; θ: the angle of inclination of the cutterhead) is imposed on the tunneling machine body through the cutterhead 3 so that the roof support 5 is about to rise because of the reaction force. In this case, the oil within the roof support cylinders 23 is slightly compressed, causing a small amount of oil leakage. Therefore, the stroke of the roof support cylinders 23 fluctuates. The fluctuation of the stroke of the roof support cylinders 23 hampers the straight-ahead movement of the tunnel boring machine. In order to keep the stroke constant, stroke control for the roof support cylinders 23 is performed in this embodiment.

Figure 7:
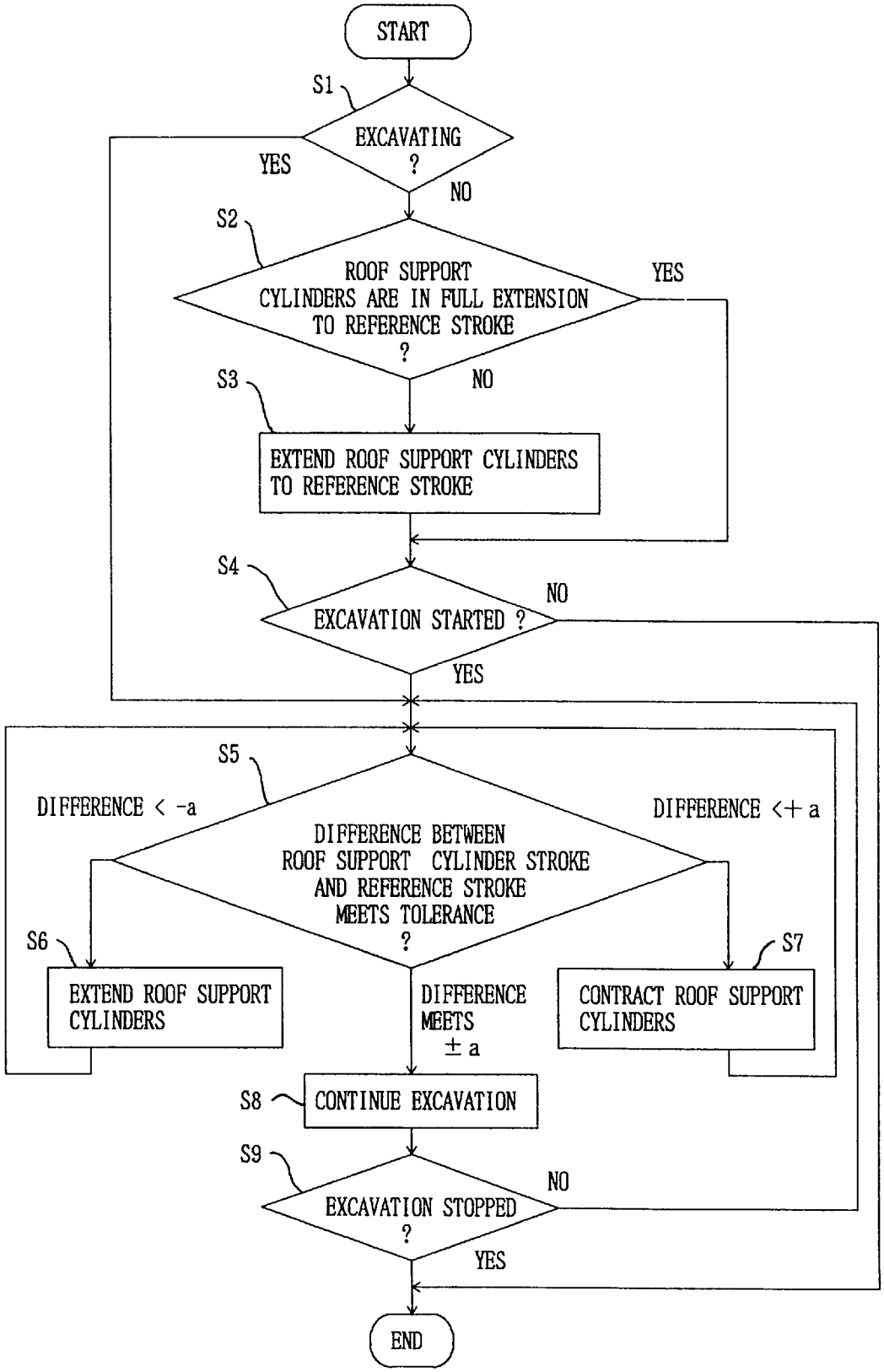
FIG. 7 is a flow chart of stroke control for a roof support cylinder.

Next, reference is made to the flow chart of FIG. 7 to explain the stroke control for the roof support cylinders 23.

S1 to S3: If the tunnel boring machine is not in excavating operation and the roof support cylinders 23 have not extended to the end of a reference stroke, the roof support cylinders 23 are allowed to extend to the end of the reference stroke. On the other hand, if the tunnel boring machine is in excavating operation, the program then proceeds to Step 5. If the tunnel boring machine is not in excavating operation and the roof support cylinders 23 have extended to the end of the reference stroke, the program then proceeds to Step 4, skipping Step 3. It should be noted that the reference stroke is the stroke of the roof support cylinders 23 at the time when the roof support shoes are in contact with the tunnel wall according to a design and this reference stroke is stored beforehand in a memory.

S4: A check is made to determine whether excavation by the tunnel boring machine has started, and if excavation has started, the program then proceeds Step 5. If not, the program is ended.

S5 to S7: During excavation, the difference between the present stroke of the roof support cylinders 23 and the reference stroke is calculated. If the difference meets a specified tolerance ±a, the program then proceeds to Step 8. If the difference is below −a, the roof support cylinders 23 are extended and the program returns to Step 5. If the difference exceeds +a, the roof support cylinders 23 are contracted and the program returns to Step 5. The control of the roof support cylinders 23 is performed by a cylinder controller (not shown) that controls hydraulic pressure to be supplied to the roof support cylinders 23.

S8 to S9: Excavation is continued. Then, a check is made to determine whether excavation is ended. If so, the program is ended and if not, the program returns to Step 5 to continue the stroke control.

Accordingly, the roof support 5 is so controlled as to be kept at a certain position, whereby the upward reaction force Fsinθ against excavation that acts on the tunneling machine body is offset by the reaction force $F_R$ (against the pressing force) exerted from the tunnel wall so that the tunnel boring machine advances straight ahead in a specified advancing direction.

In this embodiment, the angle of inclination θ of the cutterhead 3 with respect to a vertical plane is preferably in the range of from 32° to 45° as mentioned earlier on the grounds that when excavating a double vehicular traffic lane tunnel or a double track railway tunnel, superfluous excavation can be minimized in order to shorten the term of works and improve the operational efficiency.

Figure 8:
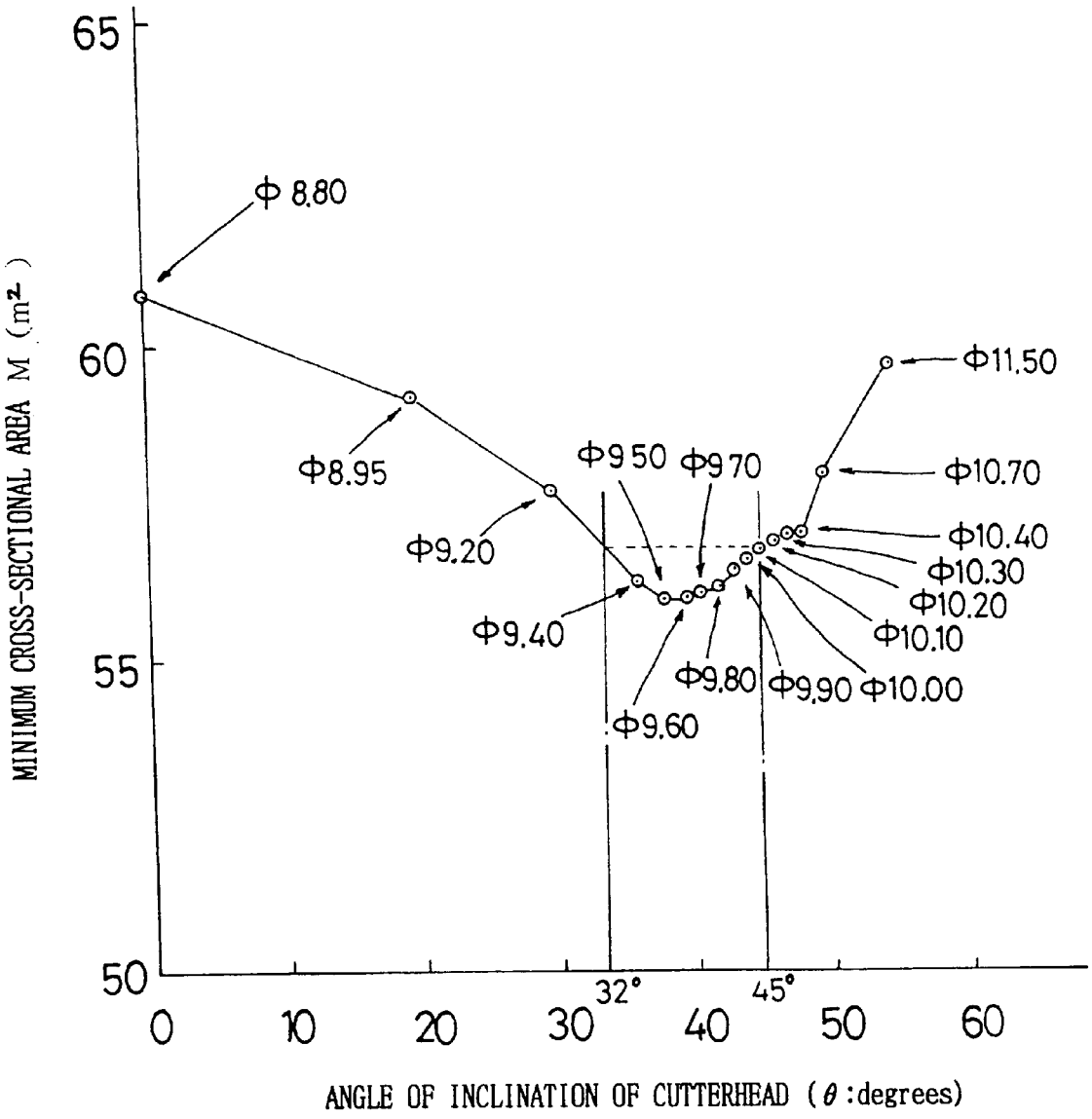
FIG. 8 is a graph showing the relationship between the angle of inclination of a cutterhead and the minimum cross-sectional area of excavation when a double track railway tunnel of a standard cross-section is excavated.
Figure 9A:
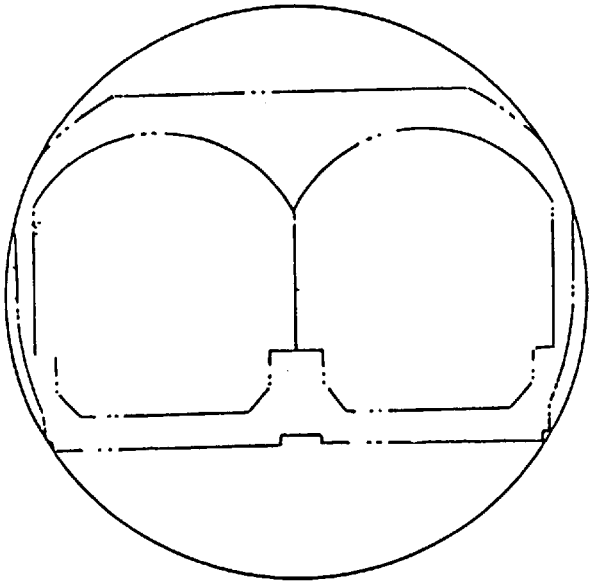
FIG. 9 is views of cross-sections of excavation associated with some of the angles of inclination of the cutterhead indicated in FIG. 8.
Figure 9B:
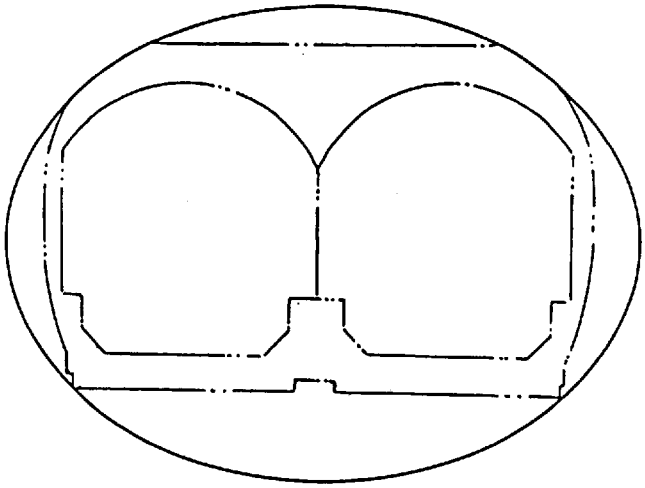
Figure 9C:
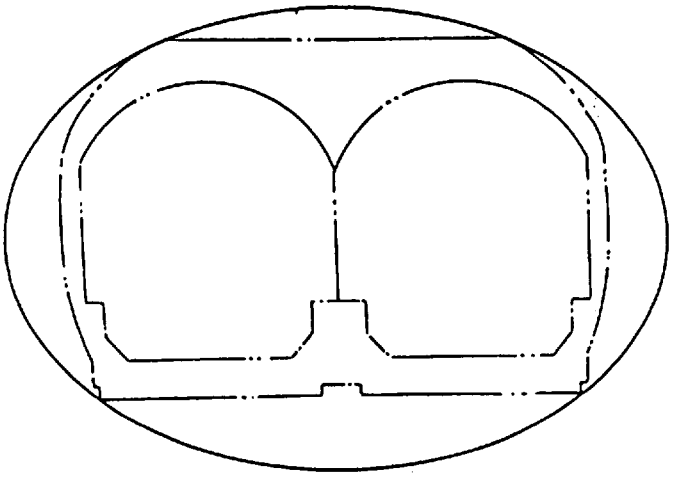
Figure 10:
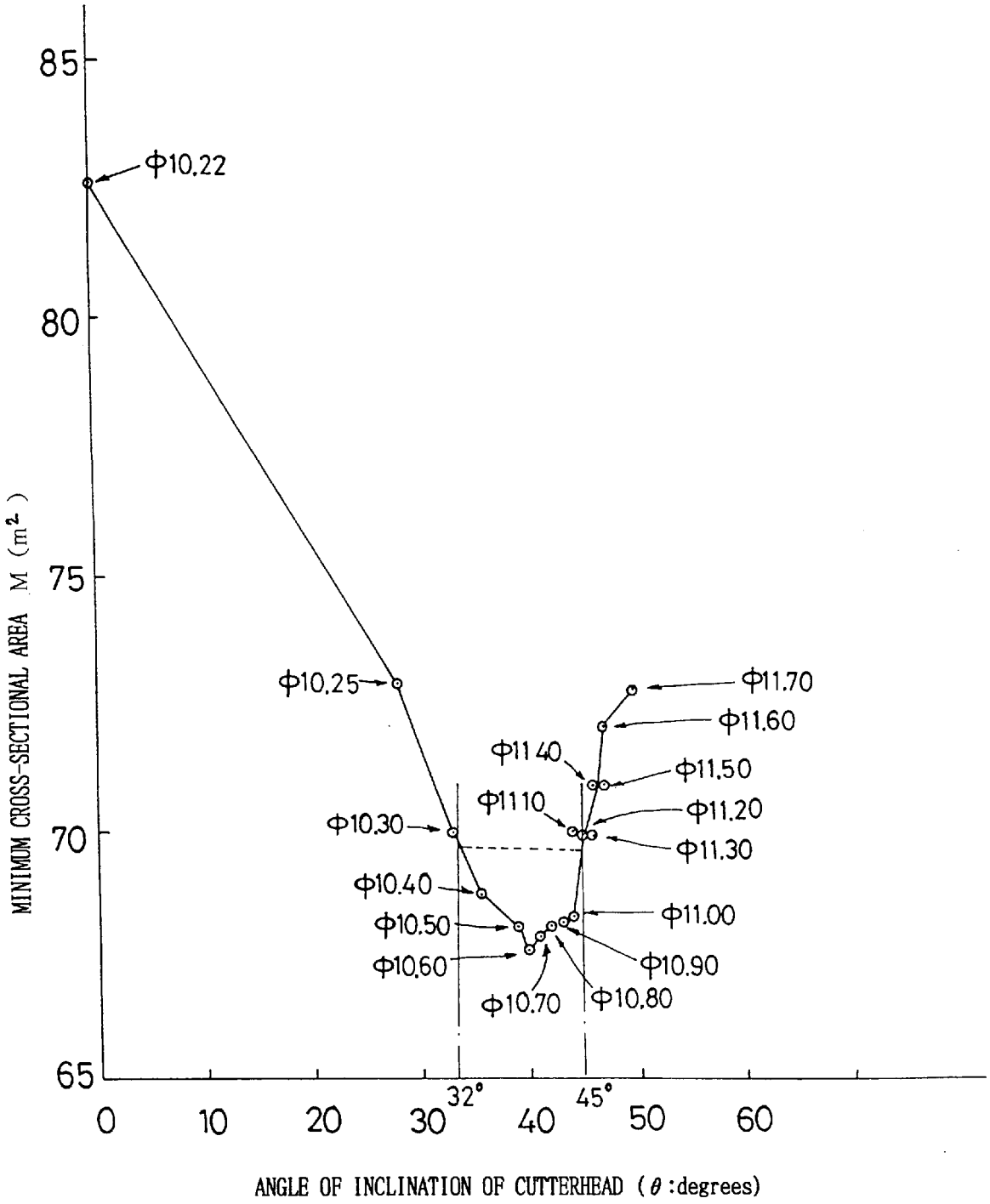
FIG. 10 is a graph showing the relationship between the angle of inclination of a cutterhead and the minimum cross-sectional area of excavation when a double vehicular traffic lane tunnel of a standard cross-section is excavated.
Figure 11:
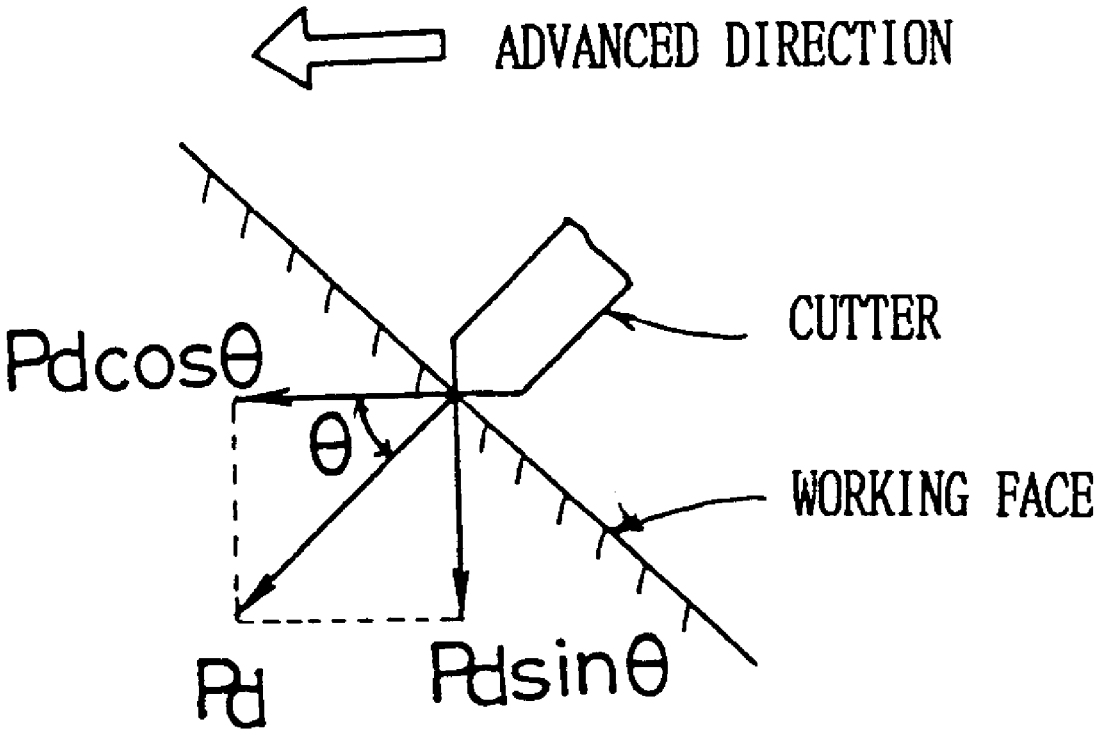
FIG. 11 is a diagram illustrating the floating force of a tunneling machine body verses the angle of inclination of the cutterhead.

FIG. 8 shows one example of the relationship between the angle of inclination θ of the cutterhead measured based on the outer diameter ϕ (the length of the longitudinal axis) of the cutterhead and the minimum cross-sectional area M when a double track railway tunnel having a standard cross-section is excavated. Of the data shown in FIG. 8, the cross-sections of excavation when θ=0°, 39.5° and 45° are shown in FIGS. 9(*a*), 9(*b*) and 9(*c*). FIG. 10 shows another example similar to FIG. 8, which relates to a double track railway tunnel having a standard cross-section.

It is obvious from FIGS. 8, 9 and 10 that in both cases of a double vehicular traffic lane tunnel and a double track railway tunnel, the cross-sectional area of excavation is the minimum where the angle of inclination θ of the cutterhead is around 40° and increases uniformly in the regions immediately before and after 40°. In the region where the angle of inclination θ exceeds 45°, the floating force of the tunneling machine body relative to the thrust increases, leading to deterioration of the operational efficiency; the roof support 5 becomes large in scale; the thrust imposed on the bearings for the rolling cutters 7 increases, which leads to a need for bearings of large capacity resulting in an increase in the size of the rolling cutters 7. In addition, it becomes difficult to keep installation space for the driving motor 11, the belt conveyor 13, the main frame 1 and others with the result that space for maintenance and repair cannot be conserved. An angle of inclination of 32° is selected because it can obtain the same cross-sectional area as achieved by an angle of inclination of 45°.

In this embodiment, the rolling cutter 7 located in the outermost periphery of the cutterhead 3 is designed, as illustrated in FIG. 6, to incline backward at a specified angle relative to the front face plate 6 on condition that the outer diameter of excavation can be ensured. With this arrangement, no portion will left uncut in the vicinity of the peripheral portion of the cutterhead 3 so that a satisfactory outer diameter of excavation can be achieved.

While the stroke control of the roof support cylinders 23 is automatically performed in this embodiment, the control may be manually performed by the operator. In this case, a stroke meter for indicating the stroke of the roof support cylinders 23 is disposed in place within the pusher 21 and the operator manually controls the hydraulic valve for the roof support cylinders 23 from the operator's cabinet, monitoring the indicative value of the stroke meter.

It should be noted that the roof support 5 of this embodiment corresponds to the support member of the invention; the pusher 21 to the pushing means; the sliding cylinder 22 to the position adjusting means (the hydraulic cylinder disposed between the tunneling machine body and the pushing means); the roof support cylinders 23 to the hydraulic cylinders disposed between the tunneling machine body and the support member; and the cylinder controller to the control means.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A tunnel boring machine for use in excavation of a tunnel of an oval cross-section, the tunnel boring machine comprising:

(a) a tunneling machine body;

(b) a cutterhead supported at a front part of the tunneling machine body so as to incline at a specified angle with respect to a vertical plane and having a circular cutting face at the front face of the cutterhead with respect to an advancing direction;

(c) a support member located in a position where it can resist a reaction force that acts generated in the direction of the periphery of the tunnel against a thrust force acting on the cutterhead;

(d) pushing means for pushing the support member toward the cutterhead, resisting the reaction force; and (e) control means for controlling the pushing means so as to constantly keep the support member at a certain position relative to the tunneling machine body.

2. A tunnel boring machine according to claim 1, further comprising position adjusting means for keeping the support member and the pushing means at respective specified positions during advance of the tunneling machine body and for moving, after the tunneling machine body has advanced with a specified pitch, the support member and the pushing means back to the respective positions where they were located before the advance of the tunneling machine body.

3. A tunnel boring machine according to claim 2, wherein said positional adjusting means a hydraulic cylinder positioned between said tunneling machine body and said pushing means.

4. A tunnel boring machine according to claim 1, wherein said pushing means comprises hydraulic cylinders positioned between said tunneling machine body and said support member and wherein said control means is a cylinder controller for controlling the stroke of the hydraulic cylinders so as to be always equal to a reference stroke.

5. A tunnel boring machine according to any one of claims 1 to 4, wherein the angle of inclination of the cutterhead ranges from 32° to 45°.

6. A tunnel boring machine according to claim 1, wherein said cutterhead includes a cutter at the outermost periphery thereof, said cutter being attached so as to incline backward at a specified angle with respect to a cutterhead face plate.

* * * * *